US009334646B2

(12) United States Patent
Hohmann, Jr.

(10) Patent No.: US 9,334,646 B2
(45) **Date of Patent: *May 10, 2016**

(54) THERMALLY-ISOLATED ANCHORING SYSTEMS WITH SPLIT TAIL VENEER TIE FOR CAVITY WALLS

(71) Applicant: Columbia Insurance Company, Omaha, NE (US)

(72) Inventor: Ronald P. Hohmann, Jr., Hauppauge, NY (US)

(73) Assignee: Columbia Insurance Company, Omaha, NE (US)

( * ) Notice: Subject to any disclaimer, the term of this patent is extended or adjusted under 35 U.S.C. 154(b) by 5 days.

This patent is subject to a terminal disclaimer.

(21) Appl. No.: 14/449,803

(22) Filed: Aug. 1, 2014

(65) Prior Publication Data

US 2016/0032582 A1 Feb. 4, 2016

(51) Int. Cl.

| | |
|---|---|
| ***E04B 1/16*** | (2006.01) |
| ***E04B 1/41*** | (2006.01) |
| *E04C 5/01* | (2006.01) |

(52) U.S. Cl.

CPC ..... *E04B 1/4178* (2013.01); *E04B 1/4185* (2013.01); *E04B 1/4157* (2013.01); *E04C 5/01* (2013.01)

(58) Field of Classification Search

CPC ... E04B 1/4178; E04B 1/4185; E04B 1/4157; E04B 2001/4192; E04B 1/41; E04B 1/16; E04B 2/06; E04C 2002/048; E04C 2002/047; E04C 5/01; E04C 5/012

USPC ..... 52/506.06, 507, 508, 509, 510–512

See application file for complete search history.

(56) References Cited

U.S. PATENT DOCUMENTS

| | | | |
|---|---|---|---|
| 819,869 | A | 5/1906 | Dunlap |
| 903,000 | A | 11/1908 | Priest |
| 1,014,157 | A | 1/1912 | Lewen |
| 1,170,419 | A | 2/1916 | Coon et al. |

(Continued)

FOREIGN PATENT DOCUMENTS

| | | | |
|---|---|---|---|
| CA | 2809061 | A1 | 9/2013 |
| CA | 2814351 | A1 | 11/2013 |

(Continued)

OTHER PUBLICATIONS

ASTM Standard E754-80 (2006), Standard Test Method for Pullout Resistance of Ties and Anchors Embedded in Masonry Mortar Joints, ASTM International, 8 pages, West Conshohocken, Pennsylvania, United States.

(Continued)

*Primary Examiner* — Phi A

(74) *Attorney, Agent, or Firm* — Senniger Powers LLP

(57) ABSTRACT

A high-strength thermally-isolating surface-mounted anchoring system for a cavity wall is disclosed. The thermally-isolated anchoring system is adaptable to various structures, including high-span applications, and for use with a split tail veneer tie. The anchoring system includes an anchor base and a stepped cylinder which sheaths the mounting hardware to limit insulation tearing and resultant loss of insulation integrity. The anchoring system is thermally-isolated through the use of multiple strategically placed compressible nonconductive seals or elements. Seals are also provided to preclude penetration of air, moisture, and water vapor into the wall structure.

20 Claims, 5 Drawing Sheets

(56) References Cited

U.S. PATENT DOCUMENTS

| | | | | | |
|---|---|---|---|---|---|
| RE15,979 | E | | 1/1925 | Schaefer et al. | |
| 1,794,684 | A | | 3/1931 | Handel | |
| 1,936,223 | A | | 11/1933 | Awbrey | |
| 1,988,124 | A | | 1/1935 | Johnson | |
| 2,058,148 | A | | 10/1936 | Hard | |
| 2,097,821 | A | | 11/1937 | Mathers | |
| 2,280,647 | A | | 4/1942 | Hawes | |
| 2,300,181 | A | | 10/1942 | Spaight | |
| 2,343,764 | A | | 3/1944 | Fuller | |
| 2,403,566 | A | | 7/1946 | Thorp et al. | |
| 2,413,772 | A | | 1/1947 | Morehouse | |
| 2,605,867 | A | | 8/1952 | Goodwin | |
| 2,780,936 | A | | 2/1957 | Hillberg | |
| 2,898,758 | A | | 8/1959 | Henrickson | |
| 2,909,054 | A | | 10/1959 | Phillips | |
| 2,929,238 | A | | 3/1960 | Kaye | |
| 2,966,705 | A | | 1/1961 | Massey | |
| 2,999,571 | A | | 9/1961 | Huber | |
| 3,030,670 | A | | 4/1962 | Bigelow | |
| 3,088,361 | A | | 5/1963 | Hallock | |
| 3,114,220 | A | | 12/1963 | Maddox et al. | |
| 3,121,978 | A | | 2/1964 | Reiland | |
| 3,183,628 | A | | 5/1965 | Smith | |
| 3,254,736 | A | | 6/1966 | Gass | |
| 3,277,626 | A | | 10/1966 | Brynjolfsson et al. | |
| 3,300,939 | A | | 1/1967 | Brynjolfsson et al. | |
| 3,309,828 | A | | 3/1967 | Tribble | |
| 3,310,926 | A | | 3/1967 | Brandreth et al. | |
| 3,341,998 | A | | 9/1967 | Lucas | |
| 3,342,005 | A | * | 9/1967 | Rickards et al. | 52/702 |
| 3,377,764 | A | | 4/1968 | Storch | |
| 3,478,480 | A | | 11/1969 | Swenson | |
| 3,563,131 | A | | 2/1971 | Ridley, Sr. | |
| 3,568,389 | A | | 3/1971 | Gulow | |
| 3,640,043 | A | | 2/1972 | Querfeld et al. | |
| 3,925,996 | A | | 12/1975 | Wiggill | |
| 3,964,226 | A | | 6/1976 | Hala et al. | |
| 3,964,227 | A | | 6/1976 | Hala | |
| 4,021,990 | A | | 5/1977 | Schwalberg | |
| 4,060,951 | A | * | 12/1977 | Gere | 52/508 |
| 4,227,359 | A | | 10/1980 | Schlenker | |
| 4,238,987 | A | | 12/1980 | Siebrecht-Reuter | |
| 4,281,494 | A | | 8/1981 | Weinar | |
| 4,305,239 | A | | 12/1981 | Geraghty | |
| 4,373,314 | A | | 2/1983 | Allan | |
| 4,382,416 | A | | 5/1983 | Kellogg-Smith | |
| 4,410,760 | A | | 10/1983 | Cole | |
| 4,424,745 | A | | 1/1984 | Magorian et al. | |
| 4,438,611 | A | | 3/1984 | Bryant | |
| 4,473,984 | A | | 10/1984 | Lopez | |
| 4,482,368 | A | | 11/1984 | Roberts | |
| 4,484,422 | A | * | 11/1984 | Roberts | 52/137 |
| 4,523,413 | A | * | 6/1985 | Koppenberg | 52/139 |
| 4,571,909 | A | | 2/1986 | Berghuis et al. | |
| 4,596,102 | A | | 6/1986 | Catani et al. | |
| 4,598,518 | A | | 7/1986 | Hohmann | |
| 4,606,163 | A | | 8/1986 | Catani | |
| 4,622,796 | A | | 11/1986 | Aziz et al. | |
| 4,628,657 | A | | 12/1986 | Ermer et al. | |
| 4,636,125 | A | | 1/1987 | Burgard | |
| 4,640,848 | A | | 2/1987 | Cerdan-Diaz et al. | |
| 4,660,342 | A | | 4/1987 | Salisbury | |
| 4,688,363 | A | | 8/1987 | Sweeney et al. | |
| 4,703,604 | A | | 11/1987 | Muller | |
| 4,708,551 | A | | 11/1987 | Richter et al. | |
| 4,714,507 | A | | 12/1987 | Ohgushi | |
| 4,738,070 | A | | 4/1988 | Abbott et al. | |
| 4,757,662 | A | | 7/1988 | Gasser | |
| 4,764,069 | A | | 8/1988 | Reinwall et al. | |
| 4,819,401 | A | | 4/1989 | Whitney, Jr. | |
| 4,827,684 | A | | 5/1989 | Allan | |
| 4,843,776 | A | | 7/1989 | Guignard | |
| 4,852,320 | A | | 8/1989 | Ballantyne | |
| 4,869,038 | A | | 9/1989 | Catani | |
| 4,869,043 | A | | 9/1989 | Hatzinikolas et al. | |
| 4,875,319 | A | | 10/1989 | Hohmann | |
| 4,911,949 | A | | 3/1990 | Iwase et al. | |
| 4,922,680 | A | | 5/1990 | Kramer et al. | |
| 4,946,632 | A | | 8/1990 | Pollina | |
| 4,955,172 | A | | 9/1990 | Pierson | |
| 5,063,722 | A | | 11/1991 | Hohmann | |
| 5,099,628 | A | | 3/1992 | Noland et al. | |
| 5,207,043 | A | | 5/1993 | McGee et al. | |
| 5,307,602 | A | | 5/1994 | Lebraut | |
| 5,392,581 | A | | 2/1995 | Hatzinikolas et al. | |
| 5,408,798 | A | | 4/1995 | Hohmann | |
| 5,440,854 | A | | 8/1995 | Hohmann | |
| 5,454,200 | A | | 10/1995 | Hohmann | |
| 5,456,052 | A | | 10/1995 | Anderson et al. | |
| 5,490,366 | A | | 2/1996 | Burns et al. | |
| 5,598,673 | A | | 2/1997 | Atkins | |
| 5,634,310 | A | | 6/1997 | Hohmann | |
| 5,644,889 | A | * | 7/1997 | Getz | 52/713 |
| 5,669,592 | A | | 9/1997 | Kearful | |
| 5,671,578 | A | | 9/1997 | Hohmann | |
| 5,673,527 | A | | 10/1997 | Coston et al. | |
| 5,755,070 | A | | 5/1998 | Hohmann | |
| 5,816,008 | A | | 10/1998 | Hohmann | |
| 5,819,486 | A | | 10/1998 | Goodings | |
| 5,845,455 | A | | 12/1998 | Johnson, III | |
| 5,953,865 | A | * | 9/1999 | Rickards | 52/139 |
| 6,000,178 | A | | 12/1999 | Goodings | |
| 6,098,364 | A | * | 8/2000 | Liu | 52/506.08 |
| 6,125,608 | A | | 10/2000 | Charlson | |
| 6,209,281 | B1 | | 4/2001 | Rice | |
| 6,279,283 | B1 | | 8/2001 | Hohmann et al. | |
| 6,284,311 | B1 | | 9/2001 | Gregorovich et al. | |
| 6,332,300 | B1 | | 12/2001 | Wakai | |
| 6,351,922 | B1 | | 3/2002 | Burns et al. | |
| 6,367,219 | B1 | | 4/2002 | Quinlan | |
| 6,508,447 | B1 | | 1/2003 | Catani et al. | |
| 6,548,190 | B2 | | 4/2003 | Spitsberg et al. | |
| 6,612,343 | B2 | | 9/2003 | Camberlin et al. | |
| 6,627,128 | B1 | | 9/2003 | Boyer | |
| 6,668,505 | B1 | | 12/2003 | Hohmann et al. | |
| 6,686,301 | B2 | | 2/2004 | Li et al. | |
| 6,718,774 | B2 | | 4/2004 | Razzell | |
| 6,735,915 | B1 | | 5/2004 | Johnson, III | |
| 6,739,105 | B2 | | 5/2004 | Fleming | |
| 6,789,365 | B1 | | 9/2004 | Hohmann et al. | |
| 6,812,276 | B2 | | 11/2004 | Yeager | |
| 6,817,147 | B1 | | 11/2004 | MacDonald | |
| 6,827,969 | B1 | | 12/2004 | Skoog et al. | |
| 6,837,013 | B2 | | 1/2005 | Foderberg et al. | |
| 6,851,239 | B1 | | 2/2005 | Hohmann et al. | |
| 6,918,218 | B2 | | 7/2005 | Greenway | |
| 6,925,768 | B2 | | 8/2005 | Hohmann et al. | |
| 6,941,717 | B2 | | 9/2005 | Hohmann et al. | |
| 6,968,659 | B2 | | 11/2005 | Boyer | |
| 7,007,433 | B2 | | 3/2006 | Boyer | |
| 7,017,318 | B1 | | 3/2006 | Hohmann et al. | |
| 7,043,884 | B2 | | 5/2006 | Moreno | |
| 7,059,577 | B1 | | 6/2006 | Burgett | |
| D527,834 | S | | 9/2006 | Thimons et al. | |
| 7,147,419 | B2 | | 12/2006 | Balbo Di Vinadio | |
| 7,152,382 | B2 | | 12/2006 | Johnson, III | |
| 7,171,788 | B2 | | 2/2007 | Bronner | |
| 7,178,299 | B2 | | 2/2007 | Hyde et al. | |
| D538,948 | S | | 3/2007 | Thimons et al. | |
| 7,225,590 | B1 | | 6/2007 | diGirolamo et al. | |
| 7,325,366 | B1 | | 2/2008 | Hohmann, Jr. et al. | |
| 7,334,374 | B2 | | 2/2008 | Schmid | |
| 7,374,825 | B2 | | 5/2008 | Hazel et al. | |
| 7,415,803 | B2 | | 8/2008 | Bronner | |
| 7,469,511 | B2 | | 12/2008 | Wobber | |
| 7,481,032 | B2 | | 1/2009 | Tarr | |
| 7,552,566 | B2 | | 6/2009 | Hyde et al. | |
| 7,562,506 | B2 | | 7/2009 | Hohmann, Jr. | |
| 7,587,874 | B2 | | 9/2009 | Hohmann, Jr. | |
| 7,654,057 | B2 | | 2/2010 | Zambelli et al. | |
| 7,735,292 | B2 | | 6/2010 | Massie | |
| 7,748,181 | B1 | | 7/2010 | Guinn | |
| 7,788,869 | B2 | | 9/2010 | Voegele, Jr. | |
| D626,817 | S | | 11/2010 | Donowho et al. | |

(56) References Cited

U.S. PATENT DOCUMENTS

| | | | | |
|---|---|---|---|---|
| 7,845,137 | B2 | 12/2010 | Hohmann, Jr. | |
| 8,015,757 | B1 | 9/2011 | Hohmann, Jr. | |
| 8,037,653 | B2 | 10/2011 | Hohmann, Jr. | |
| 8,046,956 | B1 | 11/2011 | Hohmann, Jr. | |
| 8,051,619 | B2 | 11/2011 | Hohmann, Jr. | |
| 8,096,090 | B1 | 1/2012 | Hohmann, Jr. et al. | |
| 8,109,706 | B2 | 2/2012 | Richards | |
| 8,122,663 | B1 | 2/2012 | Hohmann, Jr. et al. | |
| 8,154,859 | B2 | 4/2012 | Shahrokhi | |
| 8,201,374 | B2 | 6/2012 | Hohmann, Jr. | |
| 8,209,934 | B2 | 7/2012 | Pettingale | |
| 8,215,083 | B2 | 7/2012 | Toas et al. | |
| 8,291,672 | B2 | 10/2012 | Hohmann, Jr. et al. | |
| 8,347,581 | B2 | 1/2013 | Doerr et al. | |
| 8,375,667 | B2 | 2/2013 | Hohmann, Jr. | |
| 8,418,422 | B2 | 4/2013 | Johnson, III | |
| 8,468,765 | B1 * | 6/2013 | Kim | 52/506.06 |
| 8,511,041 | B2 | 8/2013 | Fransen | |
| 8,516,763 | B2 * | 8/2013 | Hohmann, Jr. | 52/506.05 |
| 8,516,768 | B2 | 8/2013 | Johnson, III | |
| 8,544,228 | B2 | 10/2013 | Bronner | |
| 8,555,587 | B2 | 10/2013 | Hohmann, Jr. | |
| 8,555,596 | B2 | 10/2013 | Hohmann, Jr. | |
| 8,596,010 | B2 | 12/2013 | Hohmann, Jr. | |
| 8,609,224 | B2 | 12/2013 | Li et al. | |
| 8,613,175 | B2 | 12/2013 | Hohmann, Jr. | |
| 8,635,832 | B2 | 1/2014 | Heudorfer et al. | |
| 8,661,741 | B2 | 3/2014 | Hohmann, Jr. | |
| 8,661,766 | B2 | 3/2014 | Hohmann, Jr. | |
| 8,667,757 | B1 | 3/2014 | Hohmann, Jr. | |
| 8,726,596 | B2 | 5/2014 | Hohmann, Jr. | |
| 8,726,597 | B2 | 5/2014 | Hohmann, Jr. | |
| 8,733,049 | B2 | 5/2014 | Hohmann, Jr. | |
| 8,739,485 | B2 | 6/2014 | Hohmann, Jr. | |
| 8,800,241 | B2 | 8/2014 | Hohmann, Jr. | |
| 8,833,003 | B1 | 9/2014 | Hohmann, Jr. | |
| 8,839,581 | B2 | 9/2014 | Hohmann, Jr. | |
| 8,839,587 | B2 * | 9/2014 | Hohmann, Jr. | 52/700 |
| 8,844,229 | B1 | 9/2014 | Hohmann, Jr. | |
| 8,863,460 | B2 | 10/2014 | Hohmann, Jr. | |
| 8,881,488 | B2 | 11/2014 | Hohmann, Jr. et al. | |
| 8,898,980 | B2 | 12/2014 | Hohmann, Jr. | |
| 8,904,726 | B1 | 12/2014 | Hohmann, Jr. | |
| 8,904,727 | B1 | 12/2014 | Hohmann, Jr. | |
| 8,904,730 | B2 | 12/2014 | Hohmann, Jr. | |
| 8,904,731 | B2 | 12/2014 | Hohmann, Jr. | |
| 8,910,445 | B2 | 12/2014 | Hohmann, Jr. | |
| 8,978,330 | B2 | 3/2015 | Hohmann, Jr. | |
| 9,038,351 | B2 | 5/2015 | Hohmann, Jr. | |
| 2001/0054270 | A1 | 12/2001 | Rice | |
| 2002/0047488 | A1 | 4/2002 | Webb et al. | |
| 2002/0100239 | A1 | 8/2002 | Lopez | |
| 2003/0121226 | A1 | 7/2003 | Bolduc | |
| 2003/0217521 | A1 | 11/2003 | Richardson et al. | |
| 2004/0083667 | A1 | 5/2004 | Johnson, III | |
| 2004/0187421 | A1 | 9/2004 | Johnson, III | |
| 2004/0216408 | A1 | 11/2004 | Hohmann, Jr. | |
| 2004/0216413 | A1 | 11/2004 | Hohmann et al. | |
| 2004/0216416 | A1 | 11/2004 | Hohmann et al. | |
| 2004/0231270 | A1 | 11/2004 | Collins et al. | |
| 2005/0046187 | A1 | 3/2005 | Takeuchi et al. | |
| 2005/0279042 | A1 | 12/2005 | Bronner | |
| 2005/0279043 | A1 | 12/2005 | Bronner | |
| 2006/0005490 | A1 | 1/2006 | Hohmann, Jr. | |
| 2006/0198717 | A1 | 9/2006 | Fuest | |
| 2006/0242921 | A1 | 11/2006 | Massie | |
| 2006/0251916 | A1 | 11/2006 | Arikawa et al. | |
| 2007/0011964 | A1 | 1/2007 | Smith | |
| 2008/0092472 | A1 | 4/2008 | Doerr et al. | |
| 2008/0141605 | A1 | 6/2008 | Hohmann | |
| 2008/0222992 | A1 | 9/2008 | Hikai et al. | |
| 2009/0133351 | A1 | 5/2009 | Wobber | |
| 2009/0133357 | A1 | 5/2009 | Richards | |
| 2010/0037552 | A1 | 2/2010 | Bronner | |
| 2010/0071307 | A1 | 3/2010 | Hohmann, Jr. | |
| 2010/0101175 | A1 | 4/2010 | Hohmann | |
| 2010/0192495 | A1 | 8/2010 | Huff et al. | |
| 2010/0257803 | A1 | 10/2010 | Hohmann, Jr. | |
| 2011/0023748 | A1 | 2/2011 | Wagh et al. | |
| 2011/0041442 | A1 | 2/2011 | Bui | |
| 2011/0047919 | A1 | 3/2011 | Hohmann, Jr. | |
| 2011/0061333 | A1 | 3/2011 | Bronner | |
| 2011/0083389 | A1 | 4/2011 | Bui | |
| 2011/0146195 | A1 | 6/2011 | Hohmann, Jr. | |
| 2011/0173902 | A1 | 7/2011 | Hohmann, Jr. et al. | |
| 2011/0189480 | A1 | 8/2011 | Hung | |
| 2011/0277397 | A1 | 11/2011 | Hohmann, Jr. | |
| 2012/0186183 | A1 | 7/2012 | Johnson, III | |
| 2012/0285111 | A1 | 11/2012 | Johnson, III | |
| 2012/0304576 | A1 | 12/2012 | Hohmann, Jr. | |
| 2012/0308330 | A1 | 12/2012 | Hohmann, Jr. | |
| 2013/0008121 | A1 | 1/2013 | Dalen | |
| 2013/0074435 | A1 | 3/2013 | Hohmann, Jr. | |
| 2013/0074442 | A1 | 3/2013 | Hohmann, Jr. | |
| 2013/0232893 | A1 | 9/2013 | Hohmann, Jr. | |
| 2013/0232909 | A1 | 9/2013 | Curtis et al. | |
| 2013/0247482 | A1 | 9/2013 | Hohmann, Jr. | |
| 2013/0247483 | A1 | 9/2013 | Hohmann, Jr. | |
| 2013/0247484 | A1 | 9/2013 | Hohmann, Jr. | |
| 2013/0247498 | A1 | 9/2013 | Hohmann, Jr. | |
| 2013/0340378 | A1 | 12/2013 | Hohmann, Jr. | |
| 2014/0000211 | A1 | 1/2014 | Hohmann, Jr. | |
| 2014/0075855 | A1 | 3/2014 | Hohmann, Jr. | |
| 2014/0075856 | A1 | 3/2014 | Hohmann, Jr. | |
| 2014/0075879 | A1 | 3/2014 | Hohmann, Jr. | |
| 2014/0096466 | A1 | 4/2014 | Hohmann, Jr. | |
| 2014/0174013 | A1 | 6/2014 | Hohmann, Jr. et al. | |

FOREIGN PATENT DOCUMENTS

| | | |
|---|---|---|
| CH | 279209 | 3/1952 |
| EP | 0 199 595 B1 | 3/1995 |
| GB | 1 575 501 | 9/1980 |
| GB | 2 069 024 A | 8/1981 |
| GB | 2 246 149 A | 1/1992 |
| GB | 2 265 164 A | 9/1993 |
| GB | 2459936 B | 3/2013 |

OTHER PUBLICATIONS

ASTM Standard Specification A951/A951M-11, Table 1, Standard Specification for Steel Wire for Masonry Joint Reinforcement, Nov. 14, 2011, 6 pages, West Conshohocken, Pennsylvania, United States.

State Board of Building Regulations and Standards, Building Envelope Requirements, 780 CMR sec. 1304.0 et seq., 7th Edition, Aug. 22, 2008, 11 pages, Boston, MA, United States.

Building Code Requirements for Masonry Structures and Commentary, TMS 402-11/ACI 530-11/ASCE 5-11, 2011, Chapter 6, 12 pages.

Hohmann & Barnard, Inc., Product Catalog, 44 pgs (2003).

Hohmann & Barnard, Inc.; Product Catalog, 2009, 52 pages, Hauppauge, New York, United States.

Hohmann & Barnard, Inc., Product Catalog, 2013, 52 pages, Hauppauge, New York, United States.

Kossecka, Ph.D, et al., Effect of Insulation and Mass Distribution in Exterior Walls on Dynamic Thermal Performance of Whole Buildings, Thermal Envelopes VII/Building Systems—Principles p. 721-731, 1998, 11 pages.

* cited by examiner

THERMALLY-ISOLATED ANCHORING SYSTEMS WITH SPLIT TAIL VENEER TIE FOR CAVITY WALLS

FIELD OF THE INVENTION

The invention relates to anchoring systems used in a construction industry in general and specifically relates to the anchoring systems for insulated cavity walls.

BACKGROUND OF THE INVENTION

In the past, anchoring systems have taken a variety of configurations. Where the applications included masonry backup walls, wall anchors were commonly incorporated into ladder- or truss-type reinforcements and provided wire-to-wire connections with box-ties or pintle-receiving designs on the veneer side.

In the late 1980's, surface-mounted wall anchors were developed by Hohmann & Barnard, Inc., now a MiTEK-Berkshire Hathaway Company, and patented under U.S. Pat. No. 4,598,518. The invention was commercialized under trademarks DW-10®, DW-10-X®, and DW-10-HS®. These widely accepted building specialty products were designed primarily for dry-wall construction, but were also used with masonry backup walls. For seismic applications, it was common practice to use these wall anchors as part of the DW-10® Seismiclip® interlock system which added a Byna-Tie® wire formative, a Seismiclip® snap-in device—described in U.S. Pat. No. 4,875,319 ('319), and a continuous wire reinforcement.

In an insulated dry wall application, the surface-mounted wall anchor of the above-described system has pronged legs that pierce the insulation and the wallboard and rest against the metal stud to provide mechanical stability in a four-point landing arrangement. The vertical slot of the wall anchor enables the mason to have the wire tie adjustably positioned along a pathway of up to 3.625-inch (max.). The interlock system served well and received high scores in testing and engineering evaluations which examined effects of various forces, particularly lateral forces, upon brick veneer masonry construction. However, under certain conditions, the system did not sufficiently maintain the integrity of the insulation. Also, upon the promulgation of regulations requiring significantly greater tension and compression characteristics were raised, a different structure—such as one of those described in detail below—became necessary.

Shortly after the introduction of the pronged wall anchor, a seismic veneer anchor, which incorporated an L-shaped backplate, was introduced. This was formed from either 12- or 14-gage sheetmetal and provided horizontally disposed openings in the arms thereof for pintle legs of the veneer anchor. In general, the pintle-receiving sheetmetal version of the Seismiclip interlock system served well, but in addition to the insulation integrity problem, installations were hampered by mortar buildup interfering with pintle leg insertion.

In the 1980's, an anchor for masonry veneer walls was developed and described in U.S. Pat. No. 4,764,069 by Reinwall et al., which patent is an improvement of the masonry veneer anchor of Lopez, U.S. Pat. No. 4,473,984. Here the anchors are keyed to elements that are installed using power-rotated drivers to deposit a mounting stud in a cementitious or masonry backup wall. Fittings are then attached to the stud, which includes an elongated eye and a wire tie therethrough for deposition in a bed joint of the outer wythe. It is instructive to note that pin-point loading—that is forces concentrated at substantially a single point—developed from this design configuration. This resulted, upon experiencing lateral forces over time, in the loosening of the stud.

There have been significant shifts in public sector building specifications, such as the Energy Code Requirement, Boston, Mass. (see Chapter 13 of 780 CMR, Seventh Edition). This Code sets forth insulation R-values well in excess of prior editions and evokes an engineering response opting for thicker insulation and correspondingly larger cavities. Here, the emphasis is upon creating a building envelope that is designed and constructed with a continuous air barrier to control air leakage into or out of conditioned space adjacent the inner wythe, which have resulted in architects and architectural engineers requiring larger and larger cavities in the exterior cavity walls of public buildings. These requirements are imposed without corresponding decreases in wind shear and seismic resistance levels or increases in mortar bed joint height. Thus, wall anchors are needed to occupy the same ⅜ inch high space in the inner wythe and tie down a veneer facing material of an outer wythe at a span of two or more times that which had previously been experienced.

As insulation became thicker, the tearing of insulation during installation of the pronged DW-10X® wall anchor, see supra, became more prevalent. This occurred as the installer would fully insert one side of the wall anchor before seating the other side. The tearing would occur at two times, namely, during the arcuate path of the insertion of the second leg and separately upon installation of the attaching hardware. The gapping caused in the insulation permitted air and moisture to infiltrate through the insulation along the pathway formed by the tear. While the gapping was largely resolved by placing a self-sealing, dual-barrier polymeric membrane at the site of the legs and the mounting hardware, with increasing thickness in insulation, this patchwork became less desirable. The improvements hereinbelow in surface mounted wall anchors look toward greater insulation integrity and less reliance on a patch.

Another prior art development occurred shortly after that of Reinwall/Lopez when Hatzinikolas and Pacholok of Fero Holding Ltd. introduced their sheetmetal masonry connector for a cavity wall. This device is described in U.S. Pat. Nos. 5,392,581 and 4,869,043. Here a sheetmetal plate connects to the side of a dry wall column and protrudes through the insulation into the cavity. A wire tie is threaded through a slot in the leading edge of the plate capturing an insulative plate thereunder and extending into a bed joint of the veneer. The underlying sheetmetal plate is highly thermally conductive, and the '581 patent describes lowering the thermal conductivity by foraminously structuring the plate. However, as there is no thermal break, a concomitant loss of the insulative integrity results.

Focus on the thermal characteristics of cavity wall construction is important to ensuring minimized heat transfer through the walls, both for comfort and for energy efficiency of heating and air conditioning. When the exterior is cold relative to the interior of a heated structure, heat from the interior should be prevented from passing through the outside. Similarly, when the exterior is hot relative to the interior of an air conditioned structure, heat from the exterior should be prevented from passing through to the interior. Providing a seal at the insertion points of the mounting hardware assists in controlling heat transfer.

In the course of preparing this application, several patents, became known to the inventors hereof and are acknowledged hereby:

| U.S. Pat. No. | Inventor | Issue Date |
|---|---|---|
| 4,021,990 | Schwalberg | May 10, 1977 |
| 4,373,314 | Allan | Feb. 15, 1983 |
| 4,473,984 | Lopez | Oct. 2, 1984 |
| 4,875,319 | Hohmann | Oct. 24, 1989 |
| 5,392,581 | Hatzinikolas et al. | Feb. 28, 1995 |
| 5,408,798 | Hohmann | Apr. 25, 1995 |
| 7,415,803 | Bronner | Aug. 26, 2008 |

| Patent Application | Inventor | Publication Date |
|---|---|---|
| 2010/0037552 | Bronner | Feb. 18, 2010 |

U.S. Pat. No. 4,021,990—B. J. Schwalberg—Issued May 10, 1977

Discloses a dry wall construction system for anchoring a facing veneer to wallboard/metal stud construction with a pronged sheetmetal anchor. The wall tie is embedded in the exterior wythe and is not attached to a straight wire run.

U.S. Pat. No. 4,373,314—J. A. Allan—Issued Feb. 15, 1983

Discloses a vertical angle iron with one leg adapted for attachment to a stud; and the other having elongated slots to accommodate wall ties. Insulation is applied between projecting vertical legs of adjacent angle irons with slots being spaced away from the stud to avoid the insulation.

U.S. Pat. No. 4,473,984—Lopez—Issued Oct. 2, 1984

Discloses a curtain-wall masonry anchor system wherein a wall tie is attached to the inner wythe by a self-tapping screw to a metal stud and to the outer wythe by embedment in a corresponding bed joint. The stud is applied through a hole cut into the insulation.

U.S. Pat. No. 4,875,319—R. Hohmann—Issued Oct. 24, 1989

Discloses a seismic construction system for anchoring a facing veneer to wallboard/metal stud construction with a pronged sheetmetal anchor. Wall tie is distinguished over that of Schwalberg '990 and is clipped onto a straight wire run.

U.S. Pat. No. 5,392,581—Hatzinikolas et al.—Issued Feb. 28, 1995

Discloses a cavity-wall anchor having a conventional tie wire for mounting in the brick veneer and an L-shaped sheetmetal bracket for mounting vertically between side-by-side blocks and horizontally on atop a course of blocks. The bracket has a slit which is vertically disposed and protrudes into the cavity. The slit provides for a vertically adjustable anchor.

U.S. Pat. No. 5,408,798—Hohmann—Issued Apr. 25, 1995

Discloses a seismic construction system for a cavity wall having a masonry anchor, a wall tie, and a facing anchor. Sealed eye wires extend into the cavity and wire wall ties are threaded therethrough with the open ends thereof embedded with a Hohmann'319 (see supra) clip in the mortar layer of the brick veneer.

U.S. Pat. No. 7,415,803—Bronner—Issued Aug. 26, 2008

Discloses a wing nut wall anchoring system for use with a two legged wire tie. The wing nut is rotatable in all directions to allow angular adjustment of the wire tie.

U.S. Pub. No. 2010/0037552—Bronner—Filed Jun. 1, 2009

Discloses a side-mounted anchoring system for a veneer wall tie connection. The system transfers horizontal loads between a backup wall and a veneer wall.

It should be noted however that none of the above patent documents provide a high-strength, supported surface-mounted wall anchor or anchoring systems utilizing the thermally-isolated wall anchor and split veneer tie of this invention, wherein the wall anchor assembly is thermally-isolating and self-sealing through the use of non-conductive elements affixed to the cylinder and the fastener. The prior art does not provide the wall anchor assembly which is modifiable for use in varied cavity wall structures.

As will become clear in reviewing the disclosure which follows, the cavity wall structures benefit from the recent developments described herein that lead to solving the problems of insulation integrity, thermally conductive anchoring systems, and of high-span applications, and of pin-point loading. The wall anchors, when combined with the high-strength split veneer tie provide for interconnection with panels, concrete masonry units, and rubble stone. The prior art does not provide the present novel cavity wall construction system as described herein below.

SUMMARY OF THE INVENTION

At the inner wythe, the anchoring system of the invention provides sealing along the stepped barrel of the wall anchor with seals at the insertion sites. At the outer wythe, the anchoring system provide split veneer ties for interconnection with varied outer wythes including blocks, panels and rubble stone. In addition to providing sealing within the inner wythe, the seals of the invention provide support for the wall anchor and substantially preclude lateral movement. More, specifically the invention provides a high-strength thermally-isolating surface-mounted anchoring system for use in a cavity wall structure. The anchoring system consists of a wall anchor, a series of strategically placed seals and a split tail veneer tie. The wall anchor is a stepped cylinder that contains a wallboard step with a first open end configured for insertion within the wallboard inner wythe and optionally, an insulation step with a second open end provided opposite the first open end. The stepped cylinder is attached to the inner wythe with a fastener that is sheathed by the stepped cylinder. The fastener is thermally-isolated by a multiplicity of strategically placed seals which include: a wallboard seal disposed at the juncture of the wallboard step and the first open end; an optional insulation seal disposed on the insulation step adjacent the juncture of the insulation step and the second configured open end; and a stepped cylinder seal disposed about the fastener at the juncture of the fastener body and the fastener head. The fastener is self-drilling and self-tapping. The seals are compressible sealing elements that preclude passage of fluids through the inner wythe.

The anchor base portion is a structure with a mounting surface and interconnection plate that extend into the cavity. The pate contains interconnection slots for attachment to a split tail veneer tie. Alternatively, the anchor includes a single interconnection slot. The mounting surface precludes penetration of air, moisture and water vapor through the inner wythe. The use of this innovative surface-mounted wall anchor in various applications addresses the problems of insulation integrity, pin-point loading, and thermal conductivity.

The anchoring system is disclosed as operating with a split tail veneer tie for interconnection with an outer wythe of concrete masonry units, rubble stone, or panels. The veneer tie secures two adjacent courses within the outer wythe through the use of a first and a second tab each disposed at a 90 degree angle with respect to the contiguous veneer tie cavity portion and at a substantially 180 degree angle the one from the other. The cavity portion is contiguous with one or more interconnection portions for connection with the anchor interconnection slot(s).

OBJECTS AND FEATURES OF THE INVENTION

It is the object of the present invention to provide a new and novel anchoring system assembly for a cavity wall structure, having an outer wythe of concrete masonry units, rubble stone or panels, that maintains structural integrity and provides high-strength connectivity and sealing.

It is another object of the present invention to provide an anchoring system for a cavity wall structure having a larger-than-normal cavity, which employs a split tail veneer tie.

It is a further object of the present invention to provide an anchoring system which is resistive to high levels of tension and compression, precludes pin-point loading, and, further, is detailed to prevent disengagement.

It is still yet another object of the present invention to provide an anchoring system which is constructed to maintain insulation integrity by preventing air and water penetration thereinto.

It is a feature of the present invention that the anchor assembly contains components that house a fastener and limit tearing of the insulation upon installation.

It is another feature of the present invention that the anchor assembly utilizes neoprene fittings and has only point contact with the metal studs thereby restricting thermal conductivity.

Other objects and features of the invention will become apparent upon review of the drawings and the detailed description which follows.

BRIEF DESCRIPTION OF THE DRAWING

In the following drawing, similar parts of different embodiments illustrated in the various views are afforded similar reference designators.

DETAIL DESCRIPTION OF THE INVENTION

Figure 1:
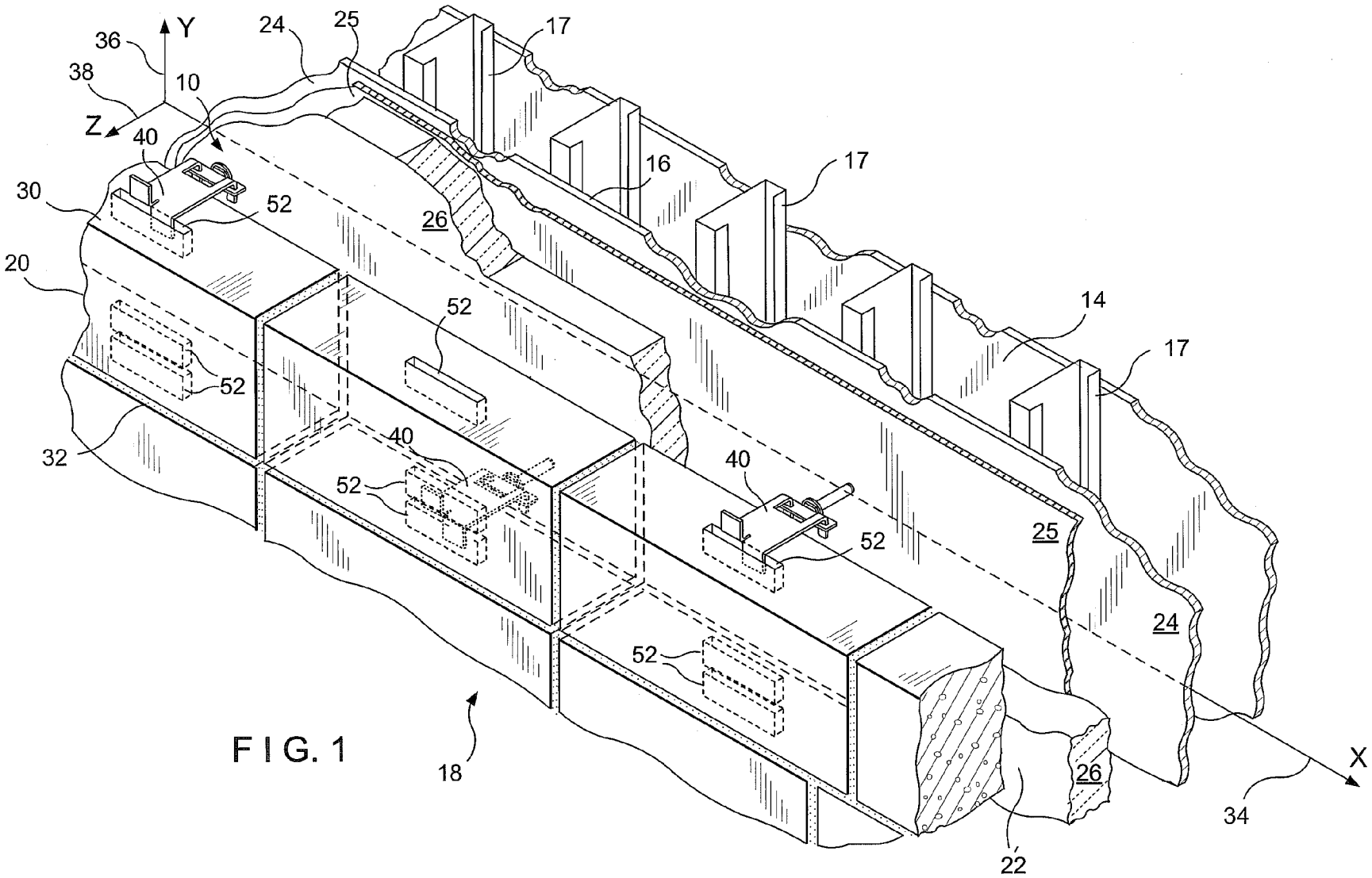
FIG. 1 is a perspective view of the invention employing one embodiment of a thermally-isolating anchor assembly as applied to a cavity wall with an inner wythe of dry wall construction having insulation and wallboard disposed on the cavity-side thereof and a split tail veneer tie.

For the purposes of clarity several terms which will be revisited later are defined. These terms are relevant to discussions of innovations introduced by the improvements of this disclosure that overcome the technical shortcomings of the prior art devices.

In the embodiments described hereinbelow, the inner wythe is provided with insulation. In the dry wall or wallboard construction, this takes the form of exterior insulation disposed on the outer surface of the inner wythe. A waterproofing membrane is optionally included. Recently, building codes have required that after the anchoring system is installed and, prior to the inner wythe being closed up, that an inspection be made for insulation integrity to ensure that the insulation prevents thermal transfer from the exterior to the interior and from the interior to the exterior. Here the term insulation integrity is used in the same sense as the building code in that, after the installation of the anchoring system, there is no change or interference with the insulative properties and concomitantly substantially no change in the air and moisture infiltration characteristics and substantially no loss of heat or air conditioned air from the interior. The present invention is designed to minimize invasiveness into the insulative layer.

Additionally, in a related sense, prior art sheetmetal anchors have formed a conductive bridge between the wall cavity and the metal studs of columns of the interior of the building. Here the terms thermal conductivity, thermally-isolated and -isolating, and thermal conductivity analysis are used to examine this phenomenon and the metal-to-metal contacts across the inner wythe. The term thermally-isolated stepped cylinder or tubule or tubule or stepped cylinder assembly for thermally isolating a surface-mounted wall anchor as used hereinafter refers to a stepped cylinder having substantially cylindrical portions with differing diameters about a common longitudinal axis and in some applications having shoulders between adjacent portions or steps. The stepped cylinder structure facilitates thermal isolation using insulative components at the shoulders thereof and between the head of the fastener and the stepped cylinder opening.

Anchoring systems for cavity walls are used to secure veneer facings to a building and overcome seismic and other forces, i.e. wind shear, etc. In the past, some systems have experienced failure because the forces have been concentrated at substantially a single point. Here, the term pin-point loading refers to an anchoring system wherein forces are concentrated at a single point. In the Description which follows, means for supporting the wall anchor shaft to limit lateral movement are taught.

In the detailed description, the wall anchor assembly is paired with a split tail veneer tie which is secured within an outer wythe of concrete masonry units, rubble stone, panels and similar interlocking units. The anchor is secured to the inner wythe through the use of fasteners or mounting hardware in a single construct or a combination of components.

Referring now to FIGS. 1, 3, 4 and 5 illustrating the first embodiment and showing a surface-mounted, thermally-isolating anchor assembly for a cavity wall with a split veneer tie. This anchor is suitable for recently promulgated standards. The system, discussed in detail herein below, is a high-strength wall anchor for connection with an inter-engaging veneer tie. The wall anchor is either surface mounted onto an externally insulated dry wall inner wythe or installed onto an externally insulated masonry inner wythe (not shown).

Figure 2:
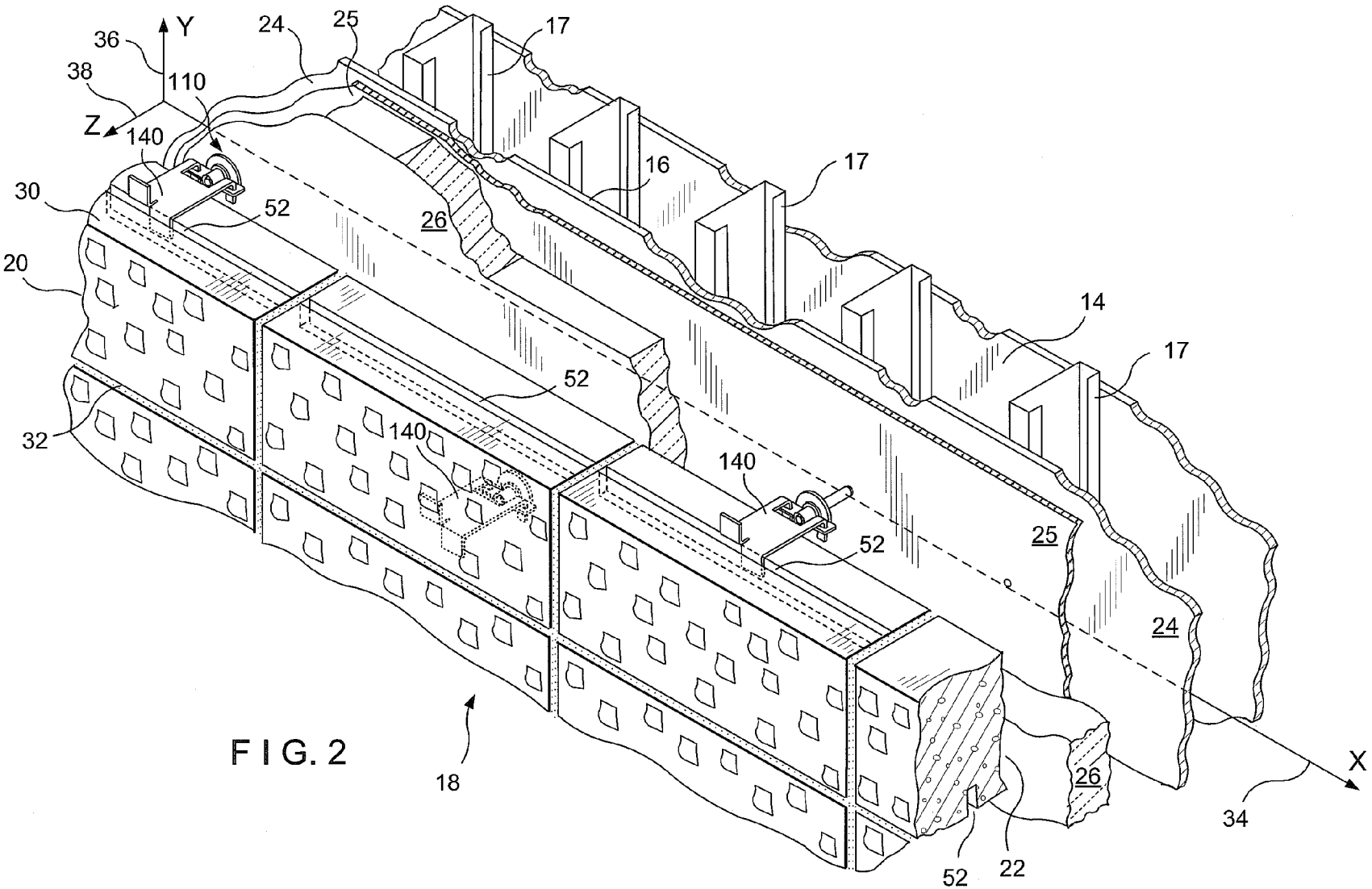
FIG. 2 is a perspective view of the invention employing another embodiment of the thermally-isolating wall anchor assembly for thermally isolating a surface-mounted wall anchor system in a cavity wall with an associated split tail wingnut veneer tie.

As to the first embodiment, an exemplary cavity wall having an insulative layer of 3½ inches (approx.) and a total span of 6 inches (approx.) has been chosen for a discussion. This structure meets the R-factor requirements of the public sector building specification. On the other hand, use of the invention with other wall structures is contemplated. The anchoring system is referred to as high-span and generally identified by the numeral 10. For purposes of discussion, the cavity surface 24 of the inner wythe 14 is illustrated in FIG. 1 containing a horizontal line or x-axis 34 and an intersecting vertical line or y-axis 36. A horizontal line or z-axis 38 also passes through the coordinate origin formed by the intersecting x- and y-axes. A cavity wall structure having an inner wythe or dry wall backup 14 with sheetrock or wallboard 16 and insulation 26 mounted on metal studs or columns 17 and an outer wythe 18 of concrete masonry units or blocks 20 is shown. Optionally, a waterproofing barrier 25 is included. Between the inner wythe 14 and the outer wythe 18, a cavity 22 is formed, which is larger-than-normal and in some applications has approximately 6-inch span. Successive bed joints 30 and 32 are formed between courses of masonry units or blocks 20. The bed joints 30 and 32 are substantially planar and disposed and in accord with building standards, so as to be 0.375-inch (approx.) in height and/or thickness. The masonry units or blocks 20 are formed with perspective anchor-receiving channels 52. In FIG. 1, the anchor-receiving channels 52 are provided within a central part of top and bottom surfaces of each block. In FIG. 2, the anchor-receiving channels 52 are shown to be continuous through the top and bottom surfaces of the blocks. Other applicable outer wythes include, but are not limited to, rubble stone and building panels (not shown).

A wall anchor 40 is surface-mounted in anchor-receiving channels 52 of the blocks 20, and is shown having an interconnecting veneer tie 44 (see FIGS. 1 and 3-5). The wall anchor 40 is formed with a base portion 41 and a stepped cylinder or stepped cylinder portion 42 having two or more external diameters and contains a wallboard step 52 and an insulation step 55 arrayed about a common longitudinal axis 47. The stepped cylinder 42 has a shaftway or aperture 50 passing therethrough to sheath a fastener 48. The anchor base or base portion 41 is an element adapted for mounting on inner wythe 14, and is configured for interconnection with a veneer tie 44. The stepped cylinder 42 extends outwardly from the base portion 41. A connecting plate 82 configured as a veneer tie receptor, with at least one interconnection slot 83 provided at one side of the base portion 41. A mounting surface 64 is facing the stepped cylinder 42 if formed at the other side of the base portion 41. The mounting surface 64 precludes penetration of air, moisture and water vapor through the inner wythe 14.

The stepped cylinder 42 is a substantially cylindrical leg formed with a wallboard step 52 having a first open end 53 adapted for insertion within the wallboard 16, and insulation step 55 having a second open end 57. Although various materials can be utilized, in the preferred embodiment of the invention, metals such as hot dipped galvanized, stainless and bright basic steel can be utilized for construction of the stepped cylinder 42.

Figure 3:
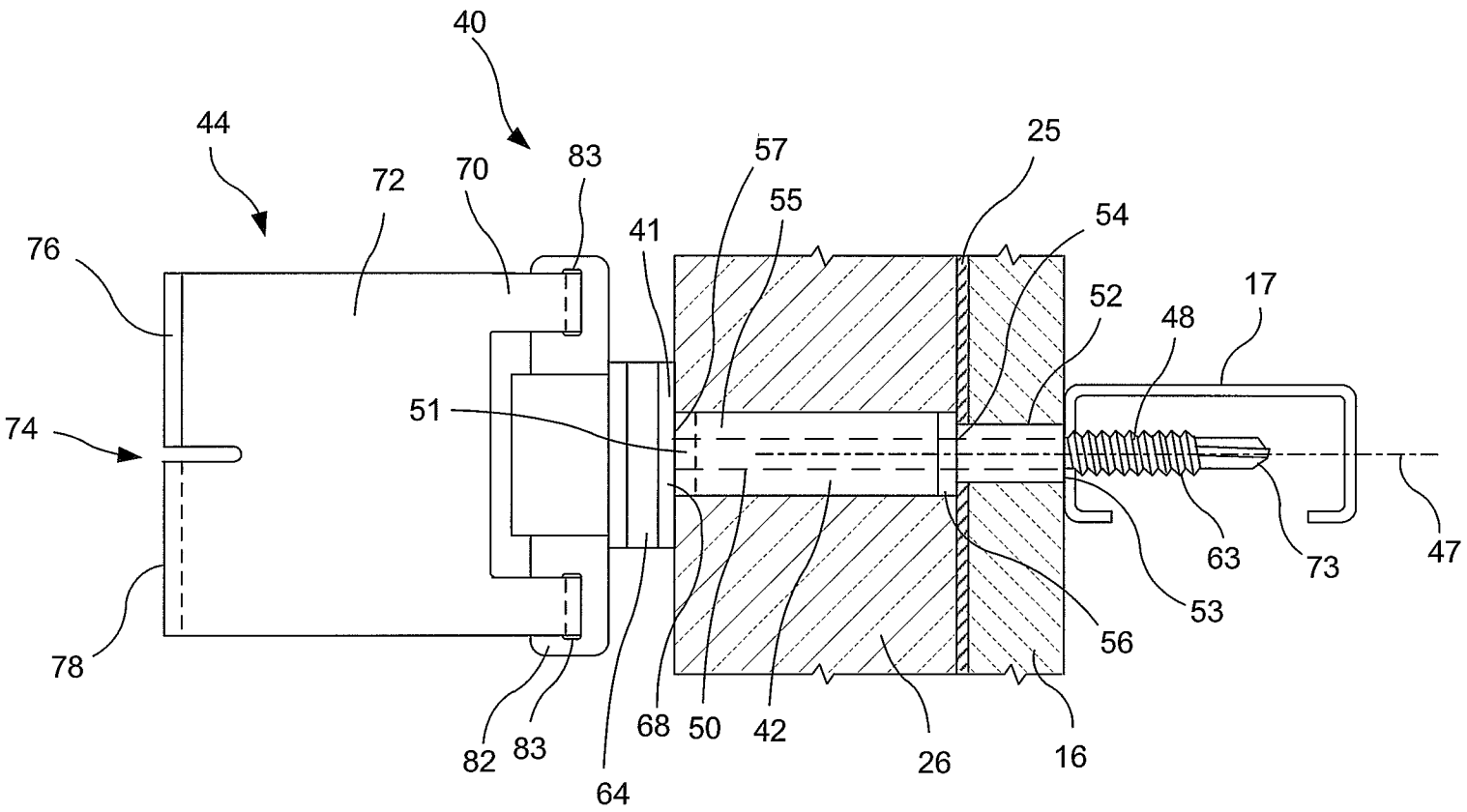
FIG. 3 is a cross-sectional view of the cavity wall and the thermally-isolating anchor assembly of FIG. 1.

The aperture 50 extends through the length of the stepped cylinder 42 and is configured for the insertion and sheathing of the fastener 48. As illustrated in FIG. 3, upon installation, when inserted within the inner wythe 14, a seal 56 and the first open end 53 are optimally located at the intersection 54 of the dry wall 16 and the insulation 26, so as to prevent undesirable thermal transfer at such intersection.

According to an essential aspect of the invention, to minimize undesirable thermal transfer between the inner wythe 14 and the anchor 10 the fastener 48 is thermally-isolated from the anchor 40 by means of multiple, strategically placed thermally-isolating elements or seals, including at least the wallboard seal 56, an insulation seal 68 and a stepped cylinder seal 51. The thermally-isolating wallboard seal 56 is provided within the stepped cylinder 42 at the juncture of the wallboard step 52 and the insulation step 55, in the vicinity of the first open end 53. The insulation seal 68 is disposed at the insulation step 55 adjacent to the juncture of the insulation step 55 and the second open end 57. The stepped cylinder seal 51 is disposed in the stepped cylinder 42 about the fastener at the juncture of the fastener shaft and the fastener head, at the juncture of the stepped cylinder 42 and the base portion 41 and seals the shaftway 50. Although a specific location of the thermally-isolating seals has been discussed above, it is within the scope of the invention to shift or extend such seals to accommodate any specific application. The fastener body 63 which is sheathed by the stepped cylinder 42 limits insulation 26 tearing. Use of various compressible, nonconductive materials for making the thermally-isolating elements or seals is within the scope of the invention. Nevertheless, in one of the embodiments the thermally-isolating elements or seals are made from neoprene.

The stepped cylinders 42 are surface-mounted at intervals along the inner wythe 14, using a respective mounting hardware. In the illustrated embodiments, the mounting hardware can be in the form of fasteners or self-tapping or self-drilling screws 48 inserted through the stepped cylinders 42. In alternate embodiments the fasteners can be provided as a part of an integral formation of the cylinders 42. The stepped cylinders 42 are adapted to sheath the exterior of mounting hardware 48. The fastener body 63 which is sheathed by the stepped cylinder 42 limits tearing of the insulation 26. The fastener has a self-tapping or self-drilling tip 73 which is affixed to the inner wythe 14 upon installation.

Upon insertion/installation into the layers of the inner wythe 14, the anchor base portion 41 through the insulation seal 68 rests snugly against the formed opening and serves to provide further sealing of the stepped cylinder 42 positioned in the aperture developed in the insulation 26. This arrangement precludes the passage of air and moisture therethrough, further enhancing the insulation integrity.

The structural relationship between the wall anchor 40 and veneer tie 44 limits the axial movement of the construct. The interconnection slots 83 are formed in the interconnecting plate 82, in accordance with the building code requirements, to be within the predetermined dimensions to limit movement of the interlocking veneer tie 44. The slots 83 are designed to accept a veneer tie 44 therethrough and to limit horizontal and vertical movement.

Figure 4:
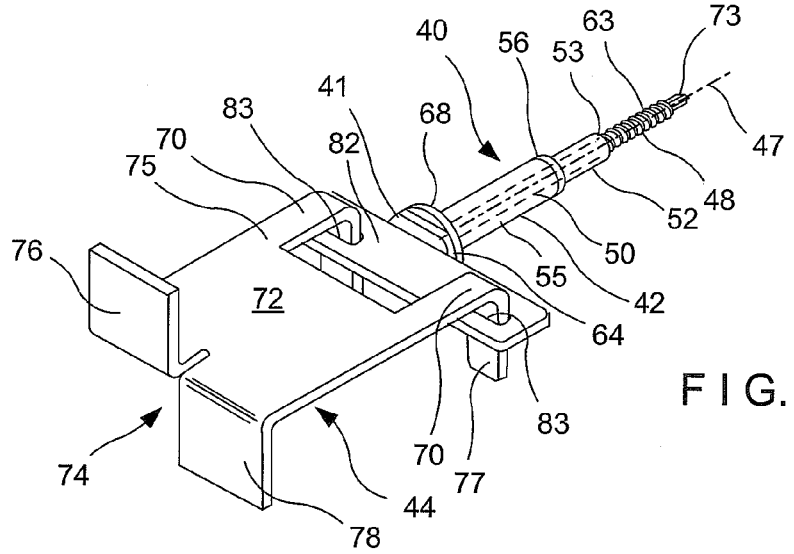
FIG. 4 is a perspective view of the thermally-isolating anchor assembly with a split tail veneer tie having a double interconnection point.
Figure 5:
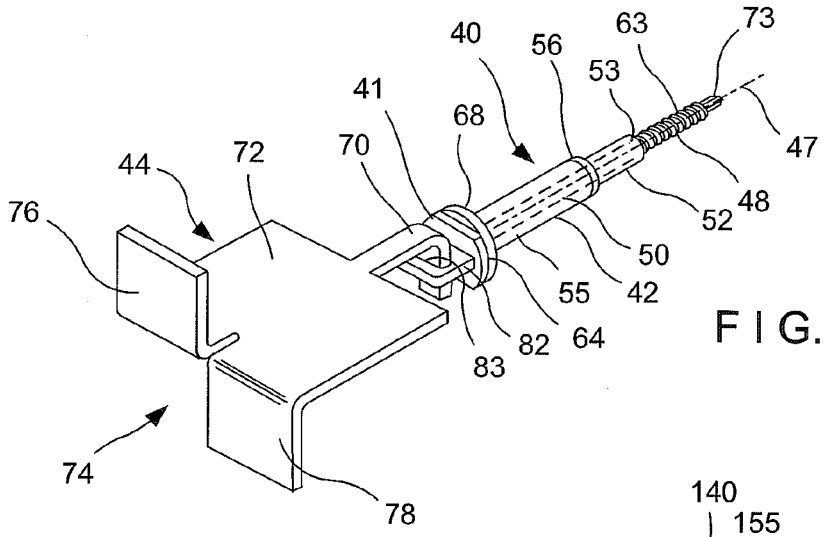
FIG. 5 is a perspective view of the thermally-isolating anchor assembly with a split tail veneer tie having a single interconnection point.

The veneer tie 44 is formed with a substantially flat cavity portion 72 extending between distal and proximal end thereof. At least one angle-shaped interconnecting portion 70 extends outwardly from the proximal end, whereas a split tail 74 is provided at the distal end. Each interconnecting portion 70 is formed by a connecting part 75 extending within a plane of the cavity portion 72 and an engaging part 77 positioned at an angle to the connecting part. The engaging part 77 is adapted to be received within the respective interconnection slot 83. In the embodiment of FIG. 4, the connecting plate 82 is formed with two interconnection slots 83. The respective veneer tie is formed with two interconnecting portions 70 spaced from each other. In this manner, the engaging parts 77 of the interconnecting portions 70 are adapted for insertion into an engagement with corresponding two interconnecting slots 83. In the embodiment of FIG. 5, the connecting plate 82 is provided with one interconnecting slot 83, which is adapted to receive the engaging part 77 of the single interconnecting portion 70 of the veneer tie 44 associate with this embodiment. In each veneer tie, a split tail 74 is provided at the distal end of the cavity portion 72 and includes a first tab 76 substantially vertically disposed at approximately 90 degree angle to the cavity portion 72, and a second tab 78 substantially vertically disposed at approximately 90 degree angle in the opposite direction from the cavity portion 72 and at a substantially 180 degree angle from the first tab 76. In use the first and second tabs 76, 78 are adapted to be inserted within the slots 52 in the blocks or panels and exterior to the rubble stone. Thus, in the assembled condition, each anchor-based portion (formed with the connecting plate 82 and configured as a veneer tie receptor) is oriented towards the outer wythe 18 and the mounting surface 82 faces the inner wythe 14. The veneer tie 44 is a single construct formed from sheet metal selected from the group consisting of hot dipped galvanized, stainless steel, and bright basic steel.

Figure 6:
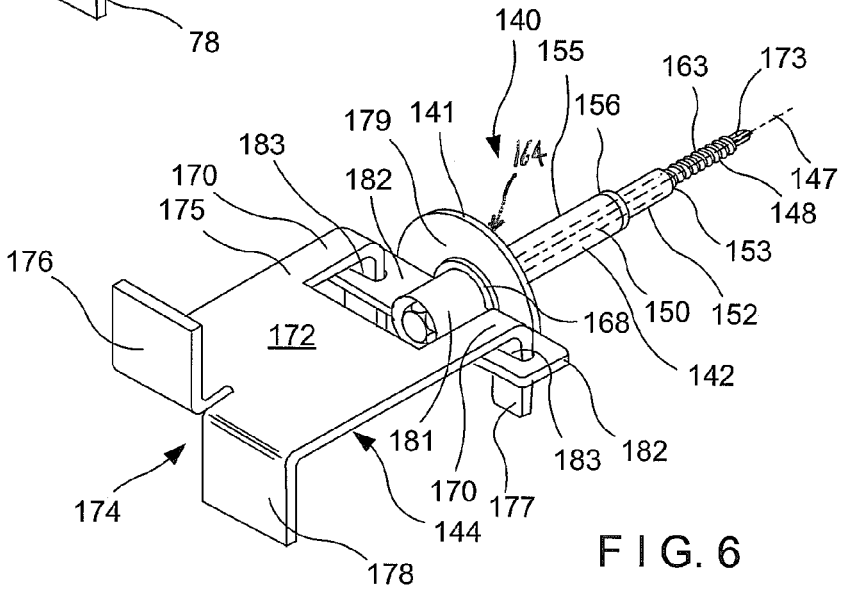
FIG. 6 is a perspective view of the thermally-isolating anchor assembly of the second embodiment of the invention also illustrated in FIG. 2.
Figure 7:
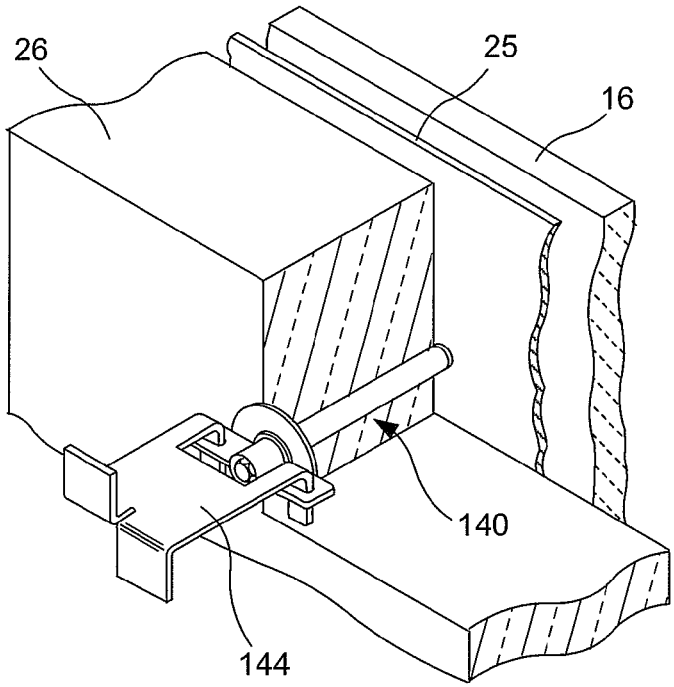
FIG. 7 is a perspective view of the second embodiment of this invention showing an anchor assembly for a thermally-isolated wall anchoring system with a split tail wingnut veneer tie.

Referring now to FIGS. 2, 6 and 7 illustrating a second embodiment of thermally-isolating anchoring system with a split tail veneer tie for cavity walls of this invention. For ease of comprehension, wherever possible similar parts use reference designators 100 units higher than those above. Thus, the stepped cylinder 142 of the second embodiment is analogous to the stepped cylinder 42 of the first embodiment. The second embodiment is shown and is referred to generally by the numeral 110. Similar to the first embodiment, an analogous wall structure illustrated in FIG. 2 is used herein.

Illustrated in FIGS. 2, 6 and 7, the anchor is suitable for recently promulgated standards with more rigorous characteristics. The system of the second embodiment discussed in detail hereinbelow, is a high-strength wall anchor for connection with an interengaging veneer tie. The wall anchor is either surface mounted onto an externally insulated dry wall inner wythe (as shown in FIGS. 2 and 7) or installed onto an externally insulated masonry inner wythe.

Similar to the above-discussed first embodiment, FIG. 2 illustrates a cavity wall having a respective insulative layer with a respective total span. This structure meets the R-factor requirements of the public sector building specification. The anchoring system is referred to as high-span and generally referred to by the numeral 110. A cavity wall structure having an inner wythe or dry wall backup 14 with sheetrock or wallboard 16 and insulation 26 mounted on metal studs or columns 17 and an outer wythe of facing concrete masonry units or blocks 18 is shown. Between the inner wythe 14 and the outer wythe 18, a cavity 22 is formed. The bed joints 30 and 32 are formed between courses of blocks 20.

For purposes of discussion, as in the previous instance, the cavity surface 24 of the inner wythe 14 is illustrated in FIG. 2 containing a horizontal line or x-axis 34 and an intersecting vertical line or y-axis 36, with z-axis 38 passing through the coordinate origin formed by the intersecting x- and y-axes. A wall anchor 140 which is surface-mounted in anchor-receiving channels 52 in the inner wythe 14 through the use of an interconnecting veneer tie 144.

The wall anchor 140 is formed with a base portion 141 and a stepped cylinder or stepped cylinder portion 142. The base portion 141 is typically a metal element for surface mounting on inner wythe 14, and for interconnection with a veneer tie 144. It is formed by a disc-shaped mounting member 179 with a collar or a substantially hollow cylindrical portion 181 extending outwardly therefrom. The base portion 141 has mounting surface 164 facing the inner wythe 14 and adjacent the stepped cylinder 142. The mounting surface 164 precludes the penetration of air, moisture and water vapor through the inner wythe 14. A connecting plate 182 is formed as two wings structure, with each having the interconnection slot 183. The wings are disposed opposite each other on the cylindrical portion 181. An aperture is provided within the mounting member 179, so as to allow the insertion and passage of the fastener 148 through the cylindrical portion into the stepped cylinder 142. Upon installation, the mounting member 179 precludes penetration of air, moisture and water vapors through the inner wythe. Upon installation, the connecting plate 182 extends into the cavity 22 substantially normal to the base portion 141 and faces towards the outer wythe 18. The stepped cylinder 142 if formed with two or more external diameters and contains a wallboard step 152. The stepped cylinder 142 has a shaftway or aperture therethrough 150 to sheath a fastener 148 and is affixed to the anchor base or base portion 141.

Similar to the first embodiment, the stepped cylinder 142 is a cylindrical elongated leg formed with a wallboard step 152 having the first end 153 configured for insertion within the wallboard 16 and insulation 25 and attached to the anchor base 141.

The aperture 150 extends through the stepped cylinder 142 allowing for the insertion and sheathing of the fastener 148. The cylinder 142 contains a wallboard step 152 with the first end 153 which is optimally located, when inserted within the inner wythe 14, at the intersection of the dry wall 16 and the columns 17 to provide a respective seal at such intersection.

To minimize thermal transfer between the inner wythe 14 and the anchor, the fasteners 148 are thermally-isolated from the respective anchors 140 by means of multiple, strategically placed thermally-isolating seals. Among the seals used in the embodiment of FIGS. 2, 6 and 7 are: a wallboard seal 156, an insulation seal 168 and a stepped cylinder seal 151. The thermally-isolating wallboard seal 156 is provided within the stepped cylinder 42 at the juncture of the wallboard step 52 and the insulation step 55 at the first open end 53. The insulation seal 168 is disposed at the exterior of the insulation step 155 adjacent to the juncture of the insulation step 155 and the second open end. The stepped cylinder seal 51 is disposed in the stepped cylinder 42 about the fastener at the juncture of the fastener shaft and the fastener head, and at the juncture of the stepped cylinder 42 and the base portion 41 and seals the shaftway 50. Although a specific location of the thermally-isolating seals has been discussed above, it is within the scope of the invention to shift or extend such seals to accommodate any specific application.

At intervals along the inner wythe surface 14, the stepped cylinders 142 are surface-mounted using mounting hardware, which can be in the form of the fastener 148 inserted through the stepped cylinders 142. Upon insertion into the layers of the inner wythe 14, to maintain the insulation integrity, the anchor base portion 141 rests snugly against the developed opening and serves to provide further sealing the stepped cylinder 142 in the insulation 26 precluding passage of air and moisture therethrough.

Upon installation angular orientation of the base portion 141 is adjustable with respect to the longitudinal axis 147. The cylindrical member 181 can be rotated, so that the connecting plate wings can be horizontally disposed to facilitate insertion engaging parts 177 of the interconnecting portions 172 into the interconnecting slots 183.

The dimensional relationship between the wall anchor 140 and veneer tie 144 limits the axial movement of the construct. The interconnection slot 183 is designed to accept a veneer tie 144 therethrough and limit horizontal and vertical movement.

The veneer tie 144 has one or more interconnecting portions 170 for disposition within the interconnecting slots 183, a cavity portion 172 contiguous with the interconnecting portion(s) 170, and a split tail 174. The split tail 174 has a first tab 176 which is vertically disposed at a substantially 90 degree angle from the cavity portion 172, and a second tab 178 vertically disposed at a substantially 90 degree angle from the cavity portion 172 and at a substantially 180 degree angle from the first tab 176. The first and second tabs 176, 178 are inserted within the apertures in the blocks 18 or panels and exterior to the rubble stone.

Figure 8:
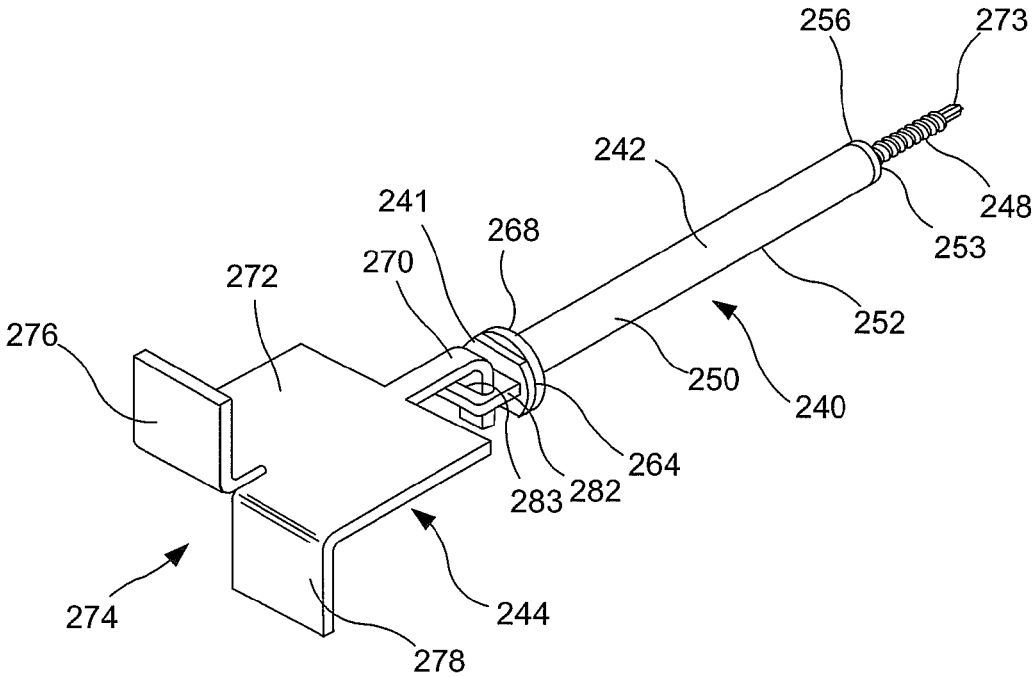
FIG. 8 is a perspective view of the thermally-isolating anchor assembly of another embodiment of the invention, showing an associated single barrel wall anchor with a split tail.

Referring now to FIG. 8, illustrating another embodiment of the thermally-isolating anchoring system with a split tail veneer tie for cavity walls of this invention. Similar to the above discussed approach, similar parts use reference designators 200 units higher than those of the first embodiment. In this embodiment, a wall structure similar to that shown in FIG. 1 is used herein.

A wall anchor 240 is surface-mounted in anchor-receiving channels 52 of the blocks 20 (see FIG. 1), and is shown having an interconnecting veneer tie 244. The wall anchor 240 is formed with a base portion 241 and a cylinder portion 242 having a single external diameter, and can be used in the wall structure without insulation. The cylinder 242 has an internal shaftway or aperture passing therethrough to sheath a fastener 248. The anchor base or base portion 241 is an element adapted for mounting on the inner wythe, and is configured for interconnection with a veneer tie 244. The single diameter cylinder 242 extends outwardly from the base portion 241. A connecting plate 282 with at least one interconnection slot 283 is provided at one side of the base portion 241. Although, the connecting plate 282 with a single interconnection slot 283 is illustrated in FIG. 8, it should be noted that the connecting plates with multiple interconnection slots, similar to that shown in FIG. 4, is within a scope of the invention. A mounting surface 264 facing the single diameter cylinder 242 is formed at the other side of the base portion 241. Upon installation, the mounting surface 264 precludes the penetration of air, moisture and water vapor through the inner wythe 14.

In the embodiment of FIG. 8 to minimize thermal transfer between the inner wythe and the anchor the fastener 248 is thermally-isolated from the anchor 240 through the use of multiple, strategically placed thermally-isolating elements including the wallboard seal 256 and the cylinder seal 251. The thermally-isolating wallboard seal 256 is provided within the cylinder 242 in the vicinity of the first open end 253. The stepped cylinder seal 251 is disposed in the stepped cylinder 242 about the fastener at the juncture of the fastener shaft and the fastener head, at the juncture of the stepped cylinder 242 and the base portion 241 and seals the shaftway 250. The fastener body 263 which is sheathed by the stepped cylinder 242 limits insulation tearing. Although a specific location of the thermally-isolating seals has been discussed above, it is within the scope of the invention to shift or extend such seals to accommodate a variety of applications.

In the above description of the thermally-isolating anchoring system of this invention sets forth various described configurations and applications thereof in corresponding anchoring systems. Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

The thermally-isolating anchoring system with a split tail veneer tie of this invention is a new and novel invention which improves on the prior art anchoring systems. The anchoring system is adaptable to varied cavity walls. The anchoring system sheaths the mounting hardware to limit insulation tearing and resultant loss of insulation integrity and disrupts thermal conductivity between the anchoring system and the inner wythe.

What is claimed is:

1. A high-strength thermally-isolating anchoring system for use in a cavity wall, the cavity wall having a wallboard inner wythe and insulation thereon, anchor-receiving channels therethrough, and an outer wythe formed from a plurality of successive courses of masonry units, rubble stones or panels, the inner wythe and the outer wythe being arranged in a spaced apart relationship with respect to each other forming a cavity therebetween, the anchoring system comprising, in combination:

a wall anchor having a stepped cylinder portion and a base portion, the wall anchor being configured for surface-mounting in the inner wythe, the wall anchor further comprising:

a stepped cylinder portion having steps thereof arrayed about a common longitudinal axis having one or more external diameters, the stepped cylinder portion containing a wallboard step and an insulation step, the stepped cylinder having a shaftway therethrough to sheath a fastener; and a base portion having a mounting surface adjacent the stepped cylinder portion, the mounting surface being configured to preclude penetration of air, moisture and water vapor through the inner wythe and is formed with one or more interconnection slots;

the fastener extending from the base portion and adapted for disposition in the shaftway of the stepped cylinder portion affixing the wall anchor to the inner wythe;

a split tail veneer tie interconnected with the one or more interconnection slots and configured for interconnection with the outer wythe; and multiple thermally-isolating seals including a wallboard seal, an insulation seal and a stepped cylinder seal, the wallboard seal being disposed within the stepped cylinder at a juncture of the wallboard step and the insulation step, the insulation seal being disposed at an exterior of the insulation step adjacent to the juncture of the insulation step and the base portion, and the stepped cylinder seal being disposed in an interior of the stepped cylinder about the fastener at the juncture of the stepped cylinder and the base portion.

2. The high-strength thermally-isolating anchoring system of claim 1, wherein the split tail veneer tie further comprises:

one or more interconnecting portions for disposition within the one or more interconnection slots;

a cavity portion contiguous with the one or more interconnecting portions;

the external diameters being configured for a press fit relationship with and for disposition in the anchor-receiving channels;

a split tail contiguous with the cavity portion and set opposite the one or more interconnecting portions, the split tail further comprising:

a first tab substantially vertically disposed at approximately 90 degree angle from the cavity portion; and, a second tab substantially vertically disposed at approximately 90 degree angle from the cavity portion and at approximately 180 degree angle from the first tab;

wherein the first and the second tab are interconnected with the outer wythe.

3. The high-strength thermally-isolating anchoring system of claim 2, wherein the veneer tie is a single construct formed from sheet metal selected from the group consisting of hot dipped galvanized, stainless steel, and bright basic steel.

4. The high-strength thermally-isolating anchoring system of claim 3, wherein the base portion is formed with a single interconnection slot.

5. The high-strength thermally-isolating anchoring system of claim 4, wherein the veneer tie has a single interconnecting portion for interconnection with the one interconnection slot.

6. The high-strength thermally-isolating anchoring system of claim 3, wherein the base portion has two interconnection slots set within two wings extending into the cavity substantially normal to the base portion.

7. The high-strength thermally-isolating anchoring system of claim 6, wherein the veneer tie has two interconnecting portions for interconnection with the two interconnection slots.

8. A high-strength thermally-isolating anchoring system for use in a cavity wall, the cavity wall having a wallboard inner wythe and insulation thereon, anchor-receiving channels therethrough, and an outer wythe formed from a plurality of successive courses of masonry units, rubble stones or panels, the inner wythe and the outer wythe in a spaced apart relationship the one with the other forming a cavity therebetween, the anchoring system comprising, in combination:

a wall anchor being a single construct and having a stepped cylinder portion and a base portion, the wall anchor being configured for surface-mounted in the inner wythe, the wall anchor further comprising:

a base portion having one or more interconnection slots, a mounting surface adjacent the stepped cylinder portion, the mounting surface being configured to minimize penetration of air, moisture and water vapor through the inner wythe, a stepped cylinder portion with the steps thereof arrayed about a common longitudinal axis having two or more external diameters configured for a press fit relationship with and for disposition in the anchor-receiving channel, the stepped cylinder having a shaftway therethrough to sheath a fastener, the stepped cylinder portion further comprising:

a wallboard step having a first end, the wallboard step configured for insertion within the wallboard;

an insulation step adjacent the wallboard step, the insulation step having a second end disposed at an end thereof opposite the first end of the wallboard step, and, a fastener for disposition in the shaftway of the stepped cylinder portion to affix the wall anchor to the inner wythe;

a stepped cylinder seal disposed about the fastener at the juncture of the fastener shaft and the fastener head, the stepped cylinder seal being a thermally-isolating element;

a wallboard seal disposed on the stepped cylinder at the juncture of the wallboard step and the insulation step, the wallboard seal being a stabilizing thermally-isolating;

an insulation seal disposed on the insulation step adjacent the juncture of the insulation step and the second configured open end, the insulation seal being a stabilizing thermally-isolating element; and, a split tail veneer tie interconnected with the one or more interconnection slots and dimensioned for interconnection with the outer wythe.

9. The high-strength thermally-isolating anchoring system of claim 8, wherein the split tail veneer tie further comprises:

one or more interconnecting portions for disposition within the one or more interconnection slots;

a cavity portion contiguous with the one or more interconnecting portions; and, a split tail contiguous with the cavity portion and set opposite the one or more interconnecting portions, the split tail further comprising:

a first tab vertically disposed at a substantially 90 degree angle from the cavity portion; and, a second tab vertically disposed at a substantially 90 degree angle from the cavity portion and at a substantially 180 degree angle from the first tab;

wherein the first and the second tab are interconnected with the outer wythe and said seals are made of compressible, nonconductive material.

10. The high-strength thermally-isolating anchoring system of claim 9, wherein the veneer tie is a single construct formed from sheet metal selected from the group consisting of hot dipped galvanized, stainless steel, and bright basic steel.

11. The high-strength thermally-isolating anchoring system of claim 10, wherein the base portion has one interconnection slot.

12. The high-strength thermally-isolating anchoring system of claim 11, wherein the veneer tie has a single interconnecting portion for interconnection with the one interconnection slot.

13. The high-strength thermally-isolating anchoring system of claim 10, wherein the base portion has two interconnection slots set within two wings extending into the cavity substantially normal to the base portion.

14. The high-strength thermally-isolating anchoring system of claim 13, wherein the veneer tie has two interconnecting portions for interconnection with the two interconnection slots.

15. A high-strength thermally-isolating anchoring system for use in a cavity wall, the cavity wall having a wallboard inner wythe and insulation thereon, anchor-receiving channels therethrough, and an outer wythe formed from a plurality of successive courses of masonry units, rubble stones or panels, the inner wythe and the outer wythe in a spaced apart relationship the one with the other forming a cavity therebetween, the anchoring system comprising, in combination:

a wall anchor being having a stepped cylinder portion and a base portion, the wall anchor being configured for surface-mounting in the inner wythe, the wall anchor further comprising:

a stepped cylinder portion with the steps thereof arrayed about a common longitudinal axis having at least one diameter configured for a press fit relationship with and for disposition in the anchor-receiving channel, the stepped cylinder having a shaftway therethrough to sheath a fastener; and a base portion having one or more interconnection slots, a mounting surface adjacent the stepped cylinder portion, the mounting surface being configured to preclude penetration of air, moisture and water vapor through the inner wythe;

a fastener for disposition in the aperture of the base portion and the shaftway of the stepped cylinder portion affixing the wall anchor to the inner wythe;

a stepped cylinder seal disposed about the fastener at the juncture of the fastener shaft and the fastener head, the stepped cylinder seal being a thermally-isolating neoprene fitting; and, a split tail veneer tie interconnected with the one or more interconnection slots and dimensioned for interconnection with the outer wythe.

16. The high-strength thermally-isolating anchoring system of claim 15, wherein the split tail veneer tie further comprises:

one or more interconnecting portions for disposition within the one or more interconnection slots;

a cavity portion contiguous with the one or more interconnecting portions; and, a split tail contiguous with the cavity portion and set opposite the one or more interconnecting portions, the split tail further comprising:

a first tab vertically disposed at a substantially 90 degree angle from the cavity portion; and, a second tab vertically disposed at a substantially 90 degree angle from the cavity portion and at a substantially 180 degree angle from the first tab;

wherein the first and the second tab are interconnected with the outer wythe.

17. The high-strength thermally-isolating anchoring system of claim 16, wherein the veneer tie is a single construct formed from sheet metal selected from the group consisting of hot dipped galvanized, stainless steel, and bright basic steel.

18. The high-strength thermally-isolating anchoring system of claim 17, wherein the base portion has one interconnection slot.

19. The high-strength thermally-isolating anchoring system of claim 18, wherein the veneer tie has a single interconnecting portion for interconnection with the one interconnection slot.

20. The high-strength thermally-isolating anchoring system of claim 16, wherein the base portion has two interconnection slots set within two wings extending into the cavity substantially normal to the base portion and the veneer tie has two interconnecting portions for interconnection with the two interconnection slots.

* * * * *